US007104906B2

(12) United States Patent
Coleman et al.

(10) Patent No.: US 7,104,906 B2
(45) Date of Patent: Sep. 12, 2006

(54) AERODYNAMICALLY AUGMENTED HOCKEY PUCK

(76) Inventors: Michael Coleman, 2785 SE. 5th Ct., Pompano Beach, FL (US) 33062; Simon Berdugo, 5365 Earnscliff Ave., Montreal, Quebec (CA) H3X 2P8; Andrew J. Small, 4905 Cote St. Luc Ed. #603, Montreal, Quebec (CA) H3W 2H7

( * ) Notice: Subject to any disclaimer, the term of this patent is extended or adjusted under 35 U.S.C. 154(b) by 0 days.

(21) Appl. No.: 10/946,822

(22) Filed: Sep. 21, 2004

(65) Prior Publication Data

US 2005/0064967 A1 Mar. 24, 2005

Related U.S. Application Data

(60) Provisional application No. 60/541,130, filed on Feb. 3, 2004, provisional application No. 60/506,874, filed on Sep. 30, 2003.

(51) Int. Cl.
*A63B 71/00* (2006.01)

(52) U.S. Cl. ..... 473/588

(58) Field of Classification Search ..... 473/587–589; D21/710

See application file for complete search history.

(56) References Cited

U.S. PATENT DOCUMENTS

| | | | | |
|---|---|---|---|---|
| 2,727,744 | A | 12/1955 | Watson | |
| 3,117,788 | A | 1/1964 | Buonanno et al. | |
| 3,726,526 | A | 4/1973 | Radovich | |
| 3,784,204 | A | 1/1974 | Felber | |
| D242,372 | S * | 11/1976 | Marcucci | D21/710 |
| 4,111,419 | A | 9/1978 | Pellegrino | |
| 5,149,096 | A | 9/1992 | Keating et al. | |
| 5,269,520 | A | 12/1993 | Vellines | |
| 5,275,410 | A | 1/1994 | Bellehumeur et al. | |
| 5,366,219 | A | 11/1994 | Salcer et al. | |
| D361,610 | S | 8/1995 | Malki | |
| D367,902 | S | 3/1996 | Silk | |
| 5,518,237 | A | 5/1996 | Bellehumeur | |
| 5,564,698 | A | 10/1996 | Honey et al. | |
| 5,597,161 | A | 1/1997 | Bellehumeur et al. | |
| 5,695,420 | A | 12/1997 | Bellehumeur | |
| 5,707,308 | A | 1/1998 | Liu | |
| 5,718,648 | A | 2/1998 | La Savio | |
| 5,733,213 | A | 3/1998 | Colarusso | |
| D394,483 | S | 5/1998 | Dusablon et al. | |

(Continued)

FOREIGN PATENT DOCUMENTS

DE 195 25 414 A1 1/1996

*Primary Examiner*—Raleigh W. Chiu
(74) *Attorney, Agent, or Firm*—Laurence A. Greenberg; Werner H. Stemer; Ralph E. Locher

(57) ABSTRACT

Aerodynamically augmented hockey puck design uses the dynamics of airflow around a moving body to assist in overcoming the unwanted forces of friction that inherently exist between two opposing surfaces and may be used on either an ice or other non-ice playing surface. The puck influences airflow through a symmetric ducted venting system designed to duct or vent air from multiple inlets positioned above a boundary layer to opposing outlets. The ducted venting system reduces pressure differentials between the inlet and outlet of the air channel. Circular center pocket cavities of the upper and lower planar surfaces of the hockey puck are vented to the opposite edge of the outer cylindrical surface of the hockey puck. Elliptical air channels extend radially from the circular center pocket cavity and are symmetrically placed and positioned above the boundary layer around the outer cylindrical surface of the puck.

10 Claims, 8 Drawing Sheets

Section cut B-B
Rotated 90 Degrees

U.S. PATENT DOCUMENTS

| | | | | |
|---|---|---|---|---|
| D396,255 | S | 7/1998 | Kotler | |
| 5,816,965 | A | 10/1998 | Kotler | |
| D401,649 | S | 11/1998 | Bellehumeur | |
| 5,855,528 | A | 1/1999 | Aiello et al. | |
| 5,928,096 | A * | 7/1999 | Boardman et al. | 473/588 |
| 5,976,042 | A * | 11/1999 | LaMarche et al. | 473/588 |
| 6,089,998 | A | 7/2000 | O'Neal et al. | |
| 6,200,238 | B1 | 3/2001 | Tackett | |
| 6,217,468 | B1 * | 4/2001 | Goodwin | 473/588 |
| 6,592,476 | B1 * | 7/2003 | Bellehumeur et al. | 473/588 |
| 2005/0064967 | A1 * | 3/2005 | Coleman et al. | 473/588 |

* cited by examiner

Section cut A-A

Section cut B-B
Rotated 90 Degrees

SECTION CUT C-C

Section cut D-D

Section View E-E
Rotated 26 Degrees CW

Section View D-D

AERODYNAMICALLY AUGMENTED HOCKEY PUCK

CROSS-REFERENCE TO RELATED APPLICATION

This application claims the benefit of the provisional application 60/506,874 originally filed Sep. 30, 2003 and the provisional application 60/541,130 originally filed Feb. 3, 2004 under 35 U.S.C. 119(e); this application also claims the priority, under 35 U.S.C. § 119, of Canadian patent application No. 2,442,390, filed Sep. 22, 2003; the prior applications are herewith incorporated by reference in their entirety.

FIELD OF THE INVENTION

The present invention relates to sport equipment. More particularly, the present invention relates to a reduced drag and aerodynamically augmented hockey puck for use on ice and other playing surfaces.

BACKGROUND AND RELATED ART

Hockey pucks have traditionally been used on a playing surface made of ice. The traditional ice hockey puck design allows the hockey puck to slide across the ice surface, but often exhibits irregular movement once the surface of the ice becomes rough or the hockey puck leaves the ice.

Moreover, as hockey becomes more popular, the sport is being played in a wider variety of environments and on a mixture of different playing surfaces. Most of the alternative playing surfaces being currently used are not as conducive to the traditional ice hockey puck design for stable puck movement as the more traditional smooth ice surfaces. For example, street hockey or roller hockey may, among other places, be played on blacktop or cement in a parking lot, inside on a gymnasium floor, or on the asphalt streets. Because of the uneven nature of these other playing surfaces many custom hockey puck designs have been developed for use on non-ice surfaces.

Some of the custom hockey puck designs include rollers on the planar surfaces to reduce friction between the playing surface and the puck. Often these custom puck designs incorporate surface specific mechanisms to increase the puck stability for a specific surface, but the effectiveness of these mechanisms are often exclusive to the playing surface. Moreover, some mechanisms substantially change the performance characteristics of the puck. For example, one customized puck for use on a non-ice surface uses curved channels to maintain airflow below the boundary layer. Unfortunately, the curved nature of the channels induce the puck to preferentially spin in one direction (e.g., clockwise or counter clockwise) thereby unintentionally making the customized puck a right handed or left handed puck due to the preferred rotation inherent in the design.

In view of available custom hockey puck designs, several groups have attempted to develop hockey pucks that reduce the friction of the puck against the floor surface using rollers or runners. Unfortunately, none of these available systems can provide aerodynamic venting that uses the movement of the puck, without specific regard to the playing surface, to reduce the friction of the puck against the playing surface.

SUMMARY OF THE INVENTION

The aerodynamically augmented puck has been developed in response to the current state of the art, and in particular, in response to these and other problems and needs that have not been fully or completely solved by currently available hockey pucks for various playing surfaces. More specifically, the aerodynamically augmented hockey puck incorporates a fountain lift augmentation system that includes a venting system and a strake assembly incorporated into the body of the hockey puck.

The venting system of the aerodynamically augmented puck allows for a reduction in the coefficient of friction between the playing surface and the hockey puck when the puck is in motion. The ducted venting system may also allow for the reduction or removal of any laminar flow towards the inner pocket cavity of the hockey puck. The ducted venting system further allows for continued re-energizing of the flow field around the moving hockey puck.

A hockey puck according to one embodiment of the present invention utilizes aerodynamic and ground effect forces, such as fountain lift force, generated by the venting system to counteract puck weight and to reduce the natural frictional forces between the hockey puck and the playing surface.

Being generally cylindrical in shape, the hockey puck is aerodynamically augmented by symmetric strategically located ducts positioned radially around the outer peripheral cylindrical surface of the puck. The openings for the ducts on the top and bottom of the outer peripheral cylindrical surface are preferably positioned above a boundary layer and symmetrical about the center plane of the puck, which is parallel, and midway between the two planar surfaces.

This evenly dispersed duct configuration ensures that irrespective of which planar surface is interfacing with the playing surface during puck movement, the venting system orientation is such that fountain lift forces are equally generated to act against the puck weight and reduce the force of friction while the puck is in motion.

The upper and lower planar surfaces of the aerodynamically augmented hockey puck each have a circular center pocket cavity. The uppermost duct holes exit to the pocket cavity on the opposing lower planar surface and similarly the lower most duct holes exit to the pocket cavity on the opposing upper planar surface. The upper most duct holes are preferably positioned such that they are out of any boundary layer, or unmoving air mass, that may exist on the playing surface.

The described configuration takes full advantage of the free stream air as the hockey puck moves across the playing surface. The upper most duct holes will direct free stream airflow to the opposing center pocket cavity and thereby create ground effect forces or fountain lift forces that assist to counteract the puck weight and subsequently reduce frictional forces found between the puck and the playing surface.

When the aerodynamically augmented hockey puck becomes airborne, the ducted airflow directed to the lower planar surface of the puck will have no playing surface contact, negating ground effects (fountain lift), and thereby forces on both sides of the puck will be equalized. Airborne aerodynamically augmented hockey pucks will therefore behave as per the desired flight characteristics of existing ice hockey pucks.

In a roller hockey version of the aerodynamically augmented hockey puck, the lift augmentation system will also incorporate a strake assembly. The strake assembly is incorporated into the body of the hockey puck such that radially placed strakes are exposed on the edge of each planar face. Strakes are non-structural protruding components in the form of semicircular segments, made of low coefficient of friction material, that increase in arc length as their placement moves farther from the puck center. The strakes exhibit a low coefficient of friction on relatively rough surfaces, such as those used for roller hockey. Moreover, when the hockey puck is rotating, the strakes form virtual air pockets to assist in minimizing the effects of friction.

These segmented arcs or strakes are concentric to the pucks cylindrical surface. They are placed on both the upper and the lower surfaces of the puck. Their position is also rotated such that they coincide with the exit point of the ducted vents on their respective surface. The strake assembly configuration functions to further enhance fountain lift forces by inhibiting the escape of airflow from the central pocket cavity.

The combined puck features previously described result in a reduction in frictional forces that will allow consistent puck movement in game play and thereby increase puck life, while handling characteristics will remain unchanged. Moreover, the improvements increase the overall speed of puck movement and minimize the effect of degrading playing surfaces on the puck behavior (i.e. snow build-up, chipped ice, debris). Other features that are considered as characteristic for the invention are set forth in the appended claims.

Although embodiments are illustrated and described herein as embodied in a aerodynamically augmented hockey puck and method of augmentation, it is, nevertheless, not intended to be limited to the details shown, because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

Additional features and advantages of the aerodynamically augmented puck will be set forth in the description that follows, and in part will be obvious from the description, or may be learned by the practice of aerodynamic puck design. The features and advantages of the aerodynamically augmented puck may also be realized and obtained by the instruments and combinations particularly pointed out in the appended claims.

BRIEF DESCRIPTION OF THE DRAWINGS

The embodiments of the invention are illustrated by way of example, and not by way of limitation, in the figures of the accompanying drawings in which like reference numerals refer to similar elements. In the drawings.

DETAILED DESCRIPTION

In the following description, numerous specific details are set forth. However, it is understood that embodiments of the invention may be practiced without these specific details. In other instances, well-known structures and techniques have not been shown in detail in order not to obscure the understanding of this description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment.

The term "profile drag" as used herein means that the subsonic drag of a streamlined, nonlifting body consists solely of skin friction and viscous separation drag. Profile drag is usually referenced to the maximum cross-sectional area of the body. The term "form drag" as used herein means drag produced by viscous separation of the boundary layer from the body. If the flow separates nearer to the front of the body the drag is much higher than if separation occurs near the rear of the body. Typically turbulent air has more energy and tends to separate slower than laminar flow. Thus the knurled surface causes turbulent air on the cylindrical surface, while the elliptical holes allows removal of any laminar flow towards the pocket and allows for the continued re-energizing of the flow field around the moving object.

Figure 1:
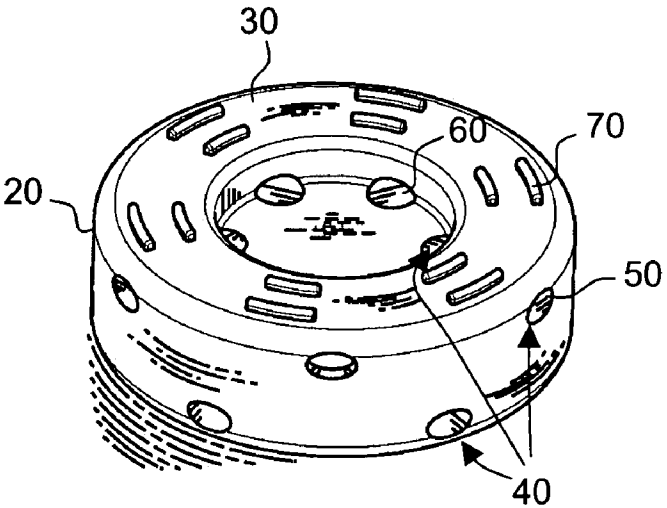
FIG. 1 is a perspective view from above of an aerodynamically augmented puck having vents and strakes according to the invention.

FIG. 1 is a perspective view from above of an aerodynamically augmented puck 10 including an outer cylindrical surface 20, identical upper and lower planar surfaces 30, a ducted venting system 40, and strakes 70 according to the invention. Exemplary augmented hockey pucks include ice 12 and non-ice 10 or 14 varieties.

The puck 10 utilizes both aerodynamic and ground effect forces to reduce friction that is found between the puck 10 and a playing surface 85. The cylindrical surface 20 of the puck 10 is attached to both the upper planar surface 30*a* and a lower planar surface 30*b*.

In one embodiment, the ducted venting system 40 includes openings, such as holes or vents or ducts, which are strategically or symmetrically placed radially around a central axis 110 of the puck. Each duct includes an inlet 50 on the outer cylindrical surface and an outlet 60 in the opposing circular center pocket cavity 80. Thus, in one embodiment, if the inlet 50 were near the upper planar surface the corresponding outlet 60 would open into the lower circular center pocket cavity 80 and vice versa. Exemplary shapes for the duct opening include elliptical, circular, rectangular, triangular, and other multiangular openings. In one embodiment, the ducts are tapered from the inlet 50 to the outlet 60. Moreover, the duct inlet holes 50 are symmetrically positioned about a center plane 120 positioned between the upper and lower planar surfaces 30. More specifically, the inlet 50 should be kept above a boundary layer 90 to facilitate better free stream airflow.

In one embodiment, the duct holes extend from one edge of the cylindrical surface 20 to a center cavity 80 of the planar surface 30 opposite the inlet opening. In this way airflows from the opposite cylindrical edge to the center portion of the planar surfaces.

Figure 2:
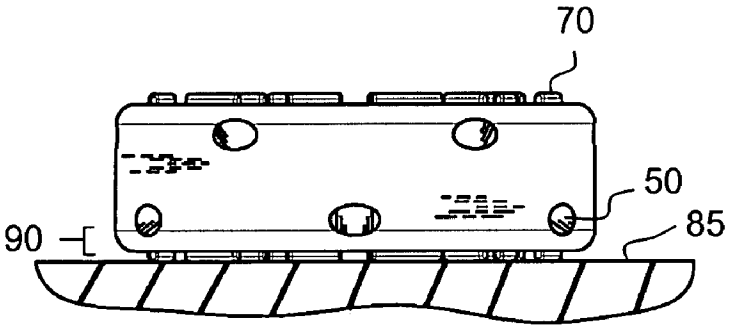
FIG. 2 is a side elevational view of the aerodynamically augmented puck according to the present invention.
Figure 10:
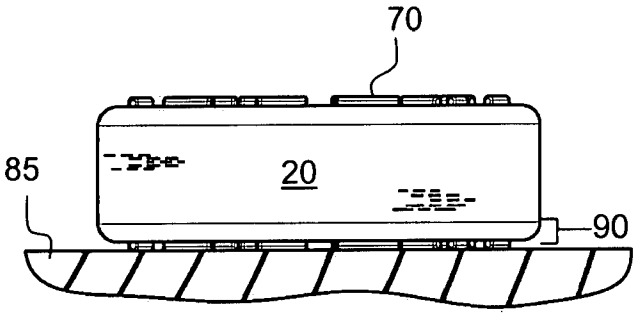
FIG. 10 is a side elevational view of the aerodynamically augmented puck of FIG. 9.

FIG. 2 illustrates a side elevational view of the aerodynamically augmented puck. FIG. 2 and the following discussion are intended to provide a brief, general description of a suitable operating environment or playing surface 85 upon which the aerodynamically augmented hockey puck 10 may be used. The duct inlets 50 are placed above the boundary layer 90, which is formed between the playing surface 85 and the hockey puck 10. In FIG. 2 and 10, the strakes 70 exhibit protrusion geometry and act as lift augmentation devices to raise the hockey puck off of the playing surface 85.

Figure 3:
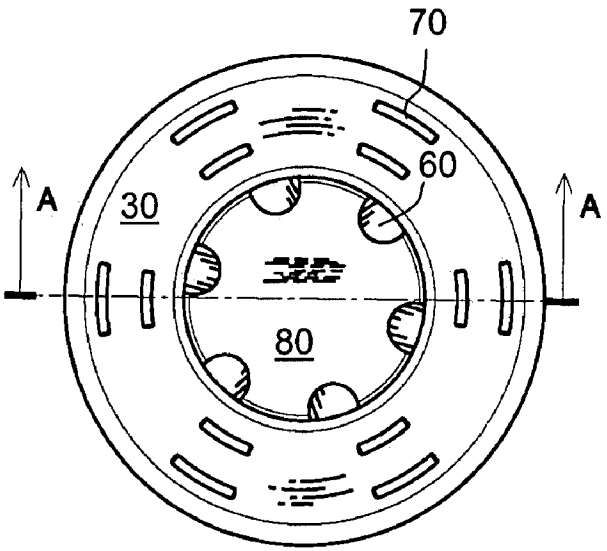
FIG. 3 is a plan view from the top or bottom of the aerodynamically augmented puck according to the invention.

FIG. 3 illustrates a plan view of an aerodynamically augmented hockey puck 10. The puck 10 includes strategically placed elliptical vents radially positioned on the cylindrical surface about a central axis and center plane. A strake assembly for providing strakes is also included in a non-ice embodiment of the present invention. FIG. 3 may represent the top or bottom view of the aerodynamically augmented puck, as the top and bottom views are essentially identical.

FIG. 3 also illustrates the concentric and circular nature of the rings of strakes 70 with respect to the planar surface 30 and the center cavity 80. In addition, the illustrated embodiment illustrates the outlets 60 of the ducts opening into the center cavity 80. The section cut A—A is illustrated in FIG. 4 and cuts through the puck without intersecting the ducted venting system 40.

Figure 4:
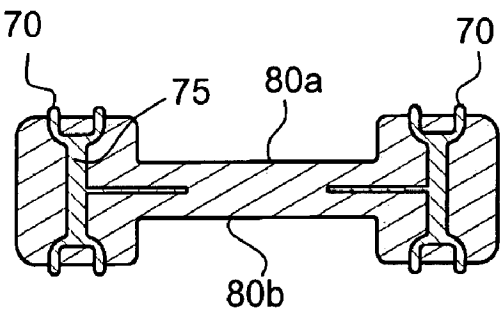
FIG. 4 is a cross-sectional view of the aerodynamically augmented puck according to the invention showing section cut A—A of FIG. 3.
Figure 5:
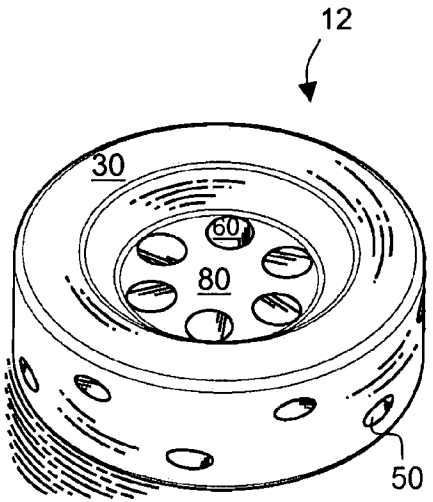
FIG. 5 is a perspective view from above of an aerodynamically augmented puck having vents according to the invention.
Figure 8:
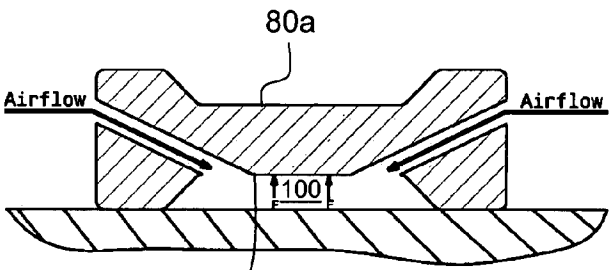
FIG. 8 is a cross-sectional view of the aerodynamically augmented puck according to the invention showing section cut B—B of FIG. 7.

FIG. 4 is a cross-sectional view of the aerodynamically augmented puck showing section cut A—A of FIG. 3. The upper center pocket cavity 80*a* and the lower center pocket cavity 80*b* are more clearly defined. In one alternative embodiment the circular edge of the cavity 80 is sloped as illustrated in FIGS. 5 and 8. As illustrated in FIG. 4, the strakes 70 of strake assembly 75 form a plurality of semicircular protruded arcs extending above the upper surface 30*a* and below the lower surface 30*b*. The strakes 70 are symmetrically positioned radially on each planar surface 30 of the hockey puck 10, 14 and are concentric with the outer cylindrical surface 20 and center cavity 80 of the puck 10, 14.

In one embodiment, the relative arc lengths of the strakes 70 or protrusions decrease as they approach the edge of the center pocket cavity 80, and increase as the strakes 70 approach the puck outer cylindrical edge 20. In one illustrated embodiment, these arcs or strakes 70 are placed such that they are inline with the exit point or outlet 60 of the ducted venting system 40 of the circular pocket cavity 80 found on each puck face.

As previously indicated, these protrusions are termed 'Strakes' and in addition to friction reducing material properties, strakes also enhance the ground effect or fountain effect of forces produced by the ducted flow of air to the bottom planar surface of the puck. In one embodiment, strake based enhancement is accomplished by inhibiting the escape of airflow from the pocket when the puck is in a surface mode, because the puck 10 is in close proximity to the playing surface 85. The rotation of the puck 10 further amplifies this effect as the spinning causes the strakes 70 to act as a secondary air pocket increasing fountain lift properties with respect to playing surface 85.

Figure 6:
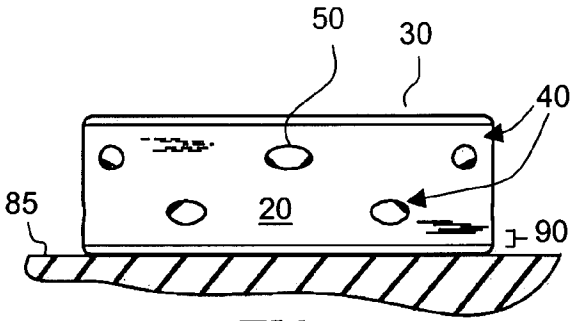
FIG. 6 is a side elevational view of the aerodynamically augmented puck of FIG. 5.

FIG. 5 is a perspective view from above of an aerodynamically augmented ice hockey puck having a ducted venting system 40. The ducted venting system 40 of the aerodynamically augmented puck 12 allows for a reduction in the coefficient of friction between the playing surface 85 and the hockey puck 12 when the puck is in motion. The ducted venting system 40 may also allow for the reduction or removal of any laminar flow towards the inner pocket cavity of the hockey puck. The ducted venting system 40 further allows for continued re-energizing of the flow field around the moving hockey puck. FIG. 6 is a side elevational view of the aerodynamically augmented puck 12 in a surface mode on the playing surface 85.

Figure 7:
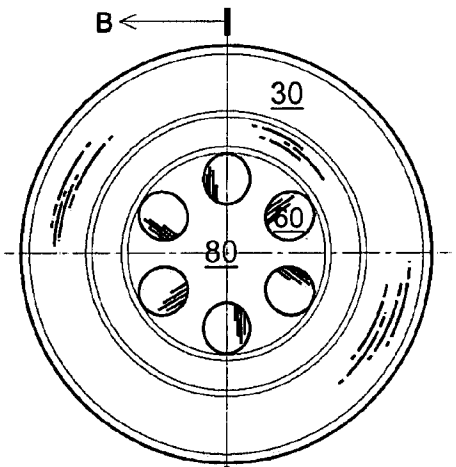
FIG. 7 is plan view from the top or bottom of the aerodynamically augmented puck of FIG. 5.

In one embodiment, the venting system 40 includes symmetrically positioned elliptical venting holes or channels extending from above the boundary layer 90 on the lower and the upper edges of the outer cylindrical surface 20 to center pocket cavities 80 formed on the opposite planar surfaces. Thus in the one embodiment, inlets 50 to ducts formed on the lower edge of the outer cylindrical surface (FIG. 6) extend up to outlets 60 in the upper center pocket cavity 80 (FIG. 7). FIG. 8 is a cross-sectional view of the aerodynamically augmented puck 12 showing section cut B—B of FIG. 7. More specifically, FIG. 8 provides a free stream surface airflow model of the puck 12. While in motion, inlets 50 to ducts on the upper edge of the outer cylindrical surface 20 extend down to outlets 60 in the lower center pocket cavity 80*b*. This airflow model generates ground effect forces or a fountain lift force 100. The fountain lift force 100 generated by the ducted venting system 40 acts to reduce natural frictional forces between the puck 12 and the playing surface 85 and to counteract puck weight.

Figure 9:
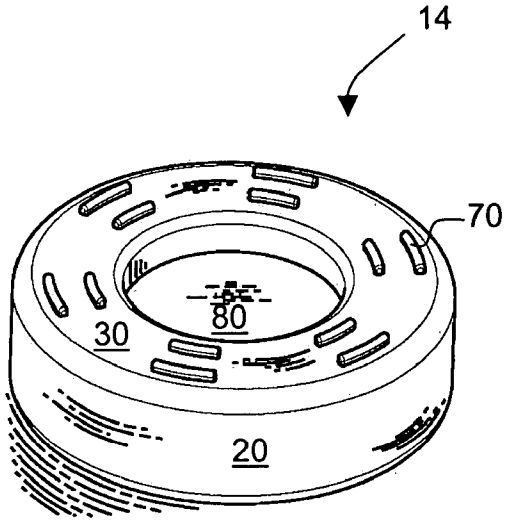
FIG. 9 is a perspective view from above of an aerodynamically augmented puck having strakes according to the invention.
Figure 12:
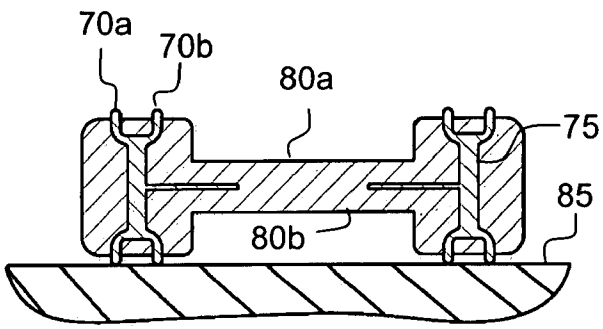
FIG. 12 is a cross-sectional view of the aerodynamically augmented puck according to the invention showing section cut C—C of FIG. 11.
Figure 11:
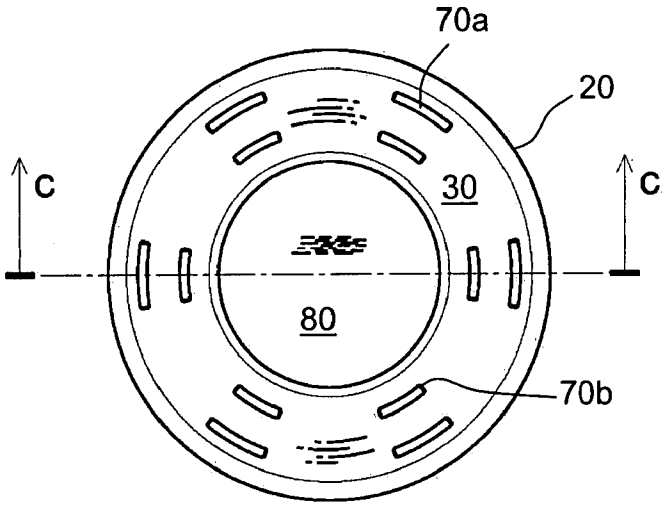
FIG. 11 is plan view from the top or bottom of the aerodynamically augmented puck of FIG. 10.

FIG. 9 is a perspective view from above of one embodiment of the aerodynamically augmented puck 14 having strakes 70 without the venting system. FIG. 10 shows a side view of the aerodynamically augmented puck 14 of FIG. 9 on playing surface 85. FIG. 11 provides a plan view from the top or bottom of the aerodynamically augmented puck 14. While FIG. 12 shows a cross-sectional view of the aerodynamically augmented puck 14 according to one embodiment across section cut C—C of FIG. 11.

Strakes 70 are non structural protruding components in the form of semicircular segments, made of low coefficient of friction material, that increase in arc length as their placement moves farther from the puck center. These segmented arcs are concentric to the pucks cylindrical surface 20. They are placed on both upper and lower planar surfaces 30 of the puck 14. Although at least one embodiment of the present invention uses rollers in combination with the venting system 40, the preferred lift augmentation device is a strake. In contrast to rollers, the strakes 70 have less surface area and a lower side profile. As a result strakes 70 offer less resistance while the puck is in motion. In one embodiment, the lower side profile of the strakes 70 promotes rotation of the puck 14, which inherently stabilizes the puck 14.

Figure 13:
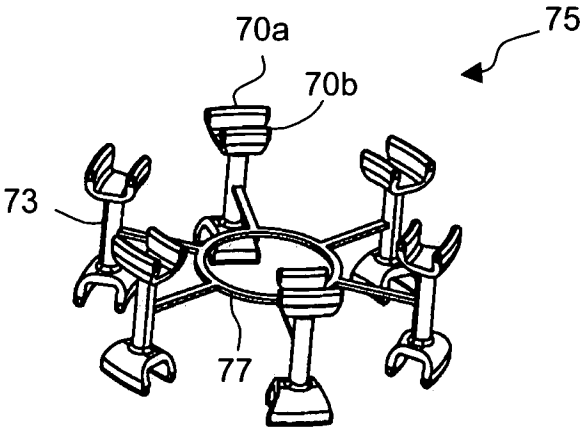
FIG. 13 is a perspective view from above of a strake assembly system according to the invention of FIG. 1 and FIG. 9.

FIG. 13 is a perspective view from above of a strake assembly system according to one embodiment. The strake assembly 75 includes a plurality of strakes 70 supported by a strake support beam 73 and coupled together via a stabilization-coupling ring 77. The wishbone configuration of the strakes and the support beam provide structural integrity to the puck.

Although the strakes 70 are preferably organized in two concentric rings (70*a* and 70*b*) around the center cavity, other embodiments use more than two rings of strakes 70. Moreover, the strakes in the figures show the coordinated alignment of the inner ring of strakes 70*b* with the outer ring of strakes 70*a*. In one non-illustrated embodiment, the inner ring and outer ring of strakes are offset to further impede the airflow from the lower cavity of the puck. However, this configuration exhibits a higher profile drag than the illustrated configuration.

Figure 16:
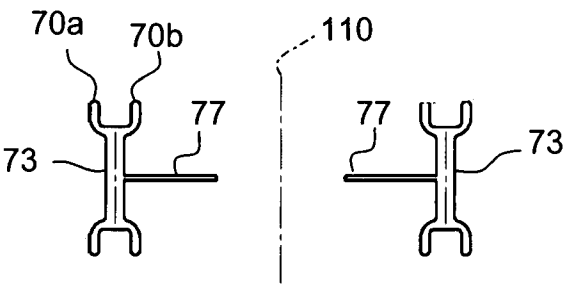
FIG. 16 is a cross-sectional view of the strake assembly system according to the invention showing section cut D—D of FIG. 14.
Figure 14:
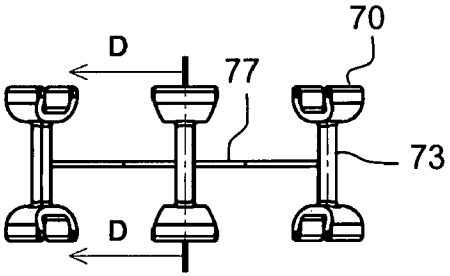
FIG. 14 is a side elevational view of the strake assembly system of FIG. 13.

FIG. 14 illustrates a side view of the strake assembly system 75. FIG. 16 is a cross-sectional view of the strake assembly system according to the invention showing section cut D—D of FIG. 14. The strake assembly system 75 is symmetric around a central axis 110 of the puck.

In one embodiment, the number of strake support beams 73 is equivalent to number of ducts being used in the augmented puck. Another embodiment reduces the number of strakes to three per ring; however, this reduction also reduces the strakes available to help generate fountain lift forces. Furthermore, if the number of ducts is also reduced, the available airflow might also be reduced. Thus, it is also considered within the scope of the claims to conceive of an embodiment where a puck is configured with a high number of ducts relative to the number of strakes. For example, eight ducts on each side and three strakes in each concentric strake ring.

Figure 15:
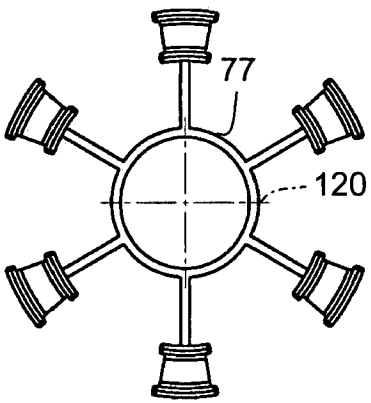
FIG. 15 is a plan view from above or below of the strake assembly system of FIG. 13.

FIG. 15 provides a plan view of the strake assembly system. The stabilization-coupling ring 77 is positioned at about the center plane 120. In one embodiment, the strakes 70 form continuous rings concentric with both the cylindrical surface 20 and the center cavity 80. This configuration further impedes the airflow from the lower cavity 80*b*, however, it also has a greater profile drag.

In one embodiment, the strakes are inserted into the puck and can be either permanent or interchangeable. The strake inserts interface with the planar surface of the puck via customized slots that match an insertion root geometry to the strake profile. In this way different strakes might be applied to the puck based on the playing surface. Moreover, one embodiment allows the strake inserts to be weighted to increase puck weight or to change the puck geometry, such that the strakes can be either flat for smooth surface play, such as ice, or having protrusions for rough surfaces, such as sport court, asphalt, or concrete surfaces.

In one embodiment, the strake assembly incorporates an interchangeability weighting system in the core of the puck that consists of cylindrical disks of various weights that can be attached either permanently or temporarily to attain a desired puck weight consistent with level of play and/or training application.

Figure 19:
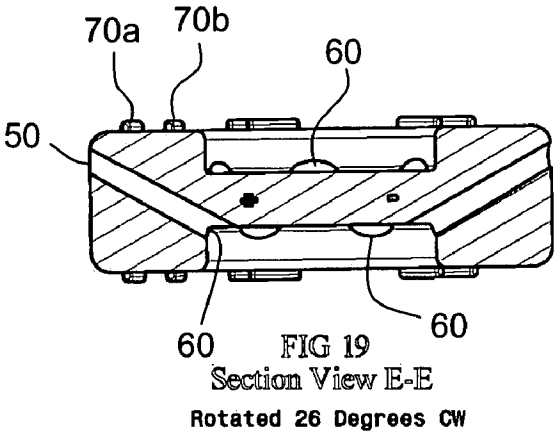
FIG. 19 is a cross-sectional view of the strake assembly system according to the invention showing section cut E—E of FIG. 17.
Figure 18:
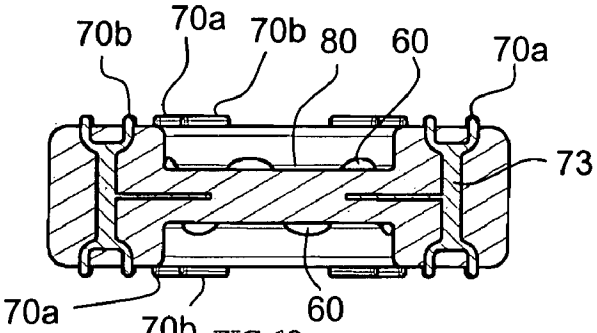
FIG. 18 is a cross-sectional view of the strake assembly system according to the invention showing section cut D—D of FIG. 17.
Figure 17:
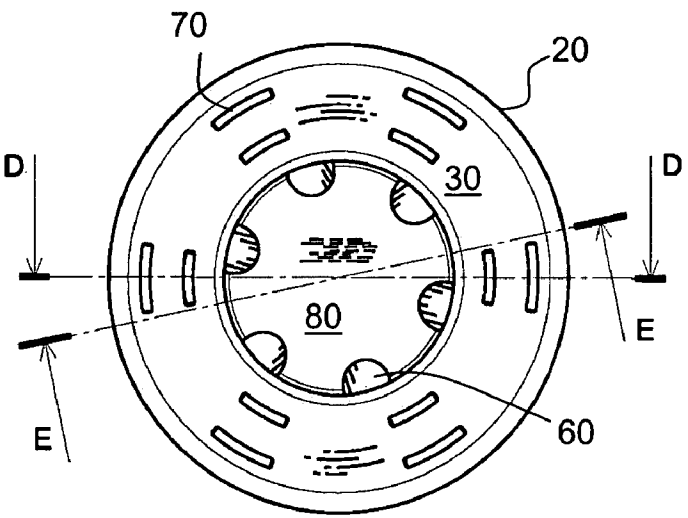
FIG. 17 is a plan view from the top or bottom of the aerodynamically augmented puck of FIG. 1 indicating to additional section views.

FIG. 17 illustrates a plan view of the aerodynamically augmented puck of FIG. 1, specifically indicating two additional section views that more clearly show the interaction between the strakes and the vented ducting system 40. Accordingly, FIG. 18 provides a section cut D—D of FIG. 17, showing a cross-section of the strake assembly system 75 interacting with the outlets 60 of the vented ducting system 40. The inner strake 70*b* and outer strake 70*a* extend past the striking surface of the puck. FIG. 19 is another cross-sectional view showing section cut E—E of FIG. 17, which provides a view of an angled duct between the inlet 50 and the outlet 60. The illustrated embodiment angles the duct from the inlet 50 to the edge of the cavity 80 on the opposing side of the puck. Alternatively, one embodiment angles the duct towards the central axis 110 of the puck 10. The taper of the ducts may also be adjusted to increase the efficiency of the venting.

In another embodiment, each of the aerodynamically augmented pucks may operate in a surface mode, as illustrated in FIG. 8 for ice hockey puck 12. Examples of the various puck embodiments in the surface mode are also illustrated in FIGS. 2, 6, and 10. In the surface mode, the vented airflow is unrestricted to the upper planar surface and restricted or impeded by the surface on the lower planar surface. The restriction of the vented airflow in surface mode occurs as the puck travels close to the playing surface so that one of the planar surfaces interfaces with the playing surface. Using the aerodynamic and ground forces generated by the vented airflow, the puck is able to take advantage of a fountain lift force in the surface mode to counteract puck weight and reduce the competing frictional forces. In the surface mode, the free stream airflow is ducted from the outer cylindrical surface to the surface interface. In one embodiment, the surface interface primarily includes the center cavity on the lower planar surface. One embodiment increases the effects of the fountain lift force using the virtual strake rings created by the rotating strakes on the lower planar surface.

In another embodiment, the aerodynamically augmented puck operates in an airborne mode. In the airborne mode, the vented airflow is unrestricted on both the upper and lower surfaces. When the aerodynamically augmented hockey puck becomes airborne, the ducted airflow directed to the lower planar surface of the puck will have no playing surface contact, thereby negating any remaining fountain lift force. As such, forces on both sides of the puck will be equalized. In airborne mode, the aerodynamically augmented hockey pucks will therefore behave according to the desired flight characteristics of existing ice hockey pucks.

Figure 20:
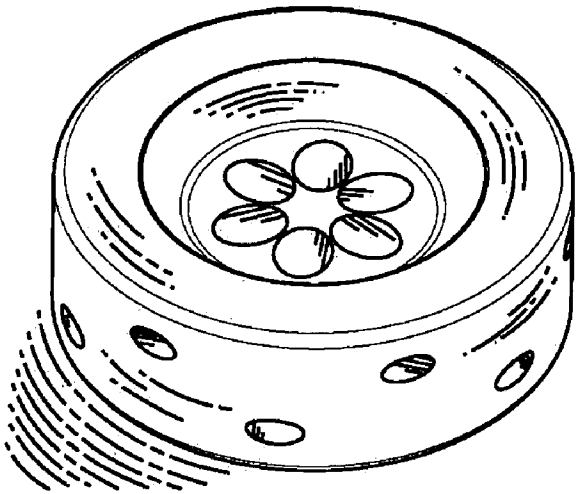
FIG. 20 is a perspective view of a puck with vents according to the invention.
Figure 21:
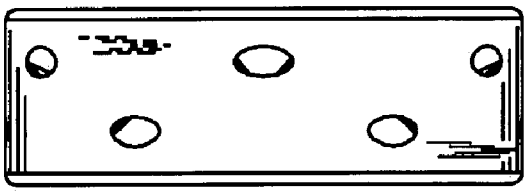
FIG. 21 is a front elevational view of a puck with vents according to the invention, of which the left, right, and back views are symmetric views thereof.
Figure 22:
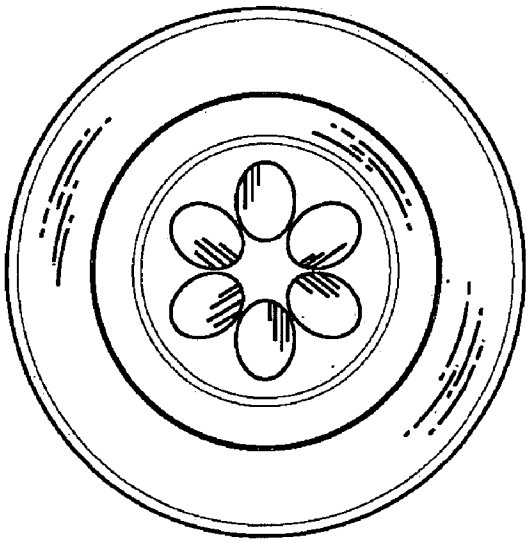
FIG. 22 is a top plan view of a puck with vents according to the invention, of which the bottom plan view is a symmetric view thereof.

FIGS. 20–22 illustrate the design aspects of a first embodiment of the invention.

Figure 23:
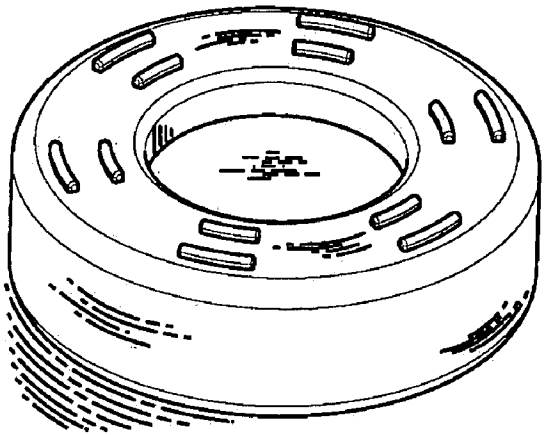
FIG. 23 is a perspective view of a puck with strakes according to the invention.
Figure 24:
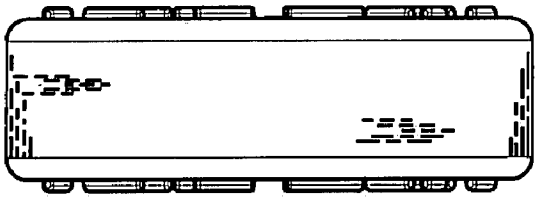
FIG. 24 is a front elevational view of a puck with strakes according to the invention, of which the left, right, and back views are symmetric views thereof.
Figure 25:
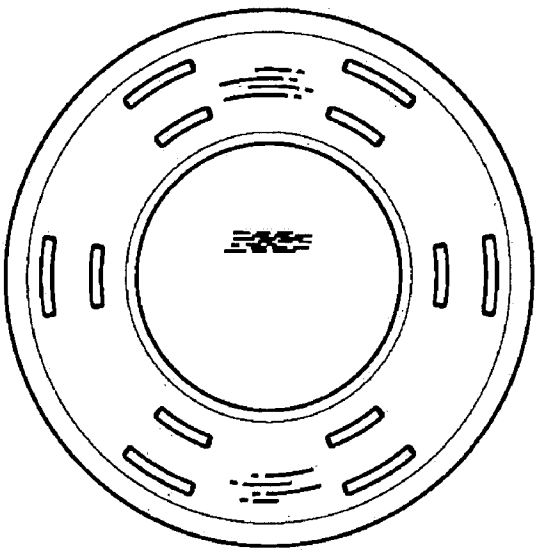
FIG. 25 is a top plan view of a puck with strakes according to the invention, of which the bottom plan view is a symmetric view thereof.

FIGS. 23–25 illustrate the design aspects of a second embodiment of the invention.

Figure 26:
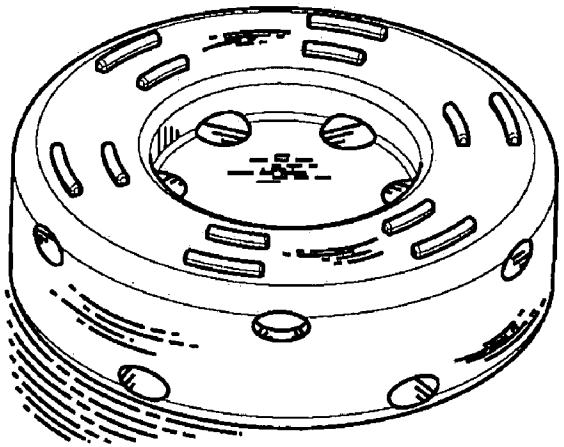
FIG. 26 is a perspective view of a puck with strakes and vents according to the invention.
Figure 27:
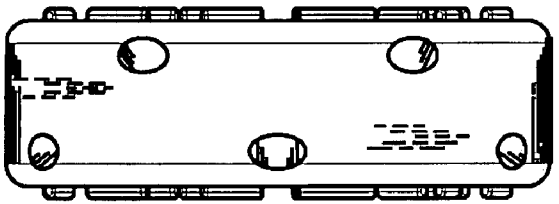
FIG. 27 is a front elevational view of a puck with strakes and vents according to the invention, of which the left, right, and back views are symmetric views thereof.
Figure 28:
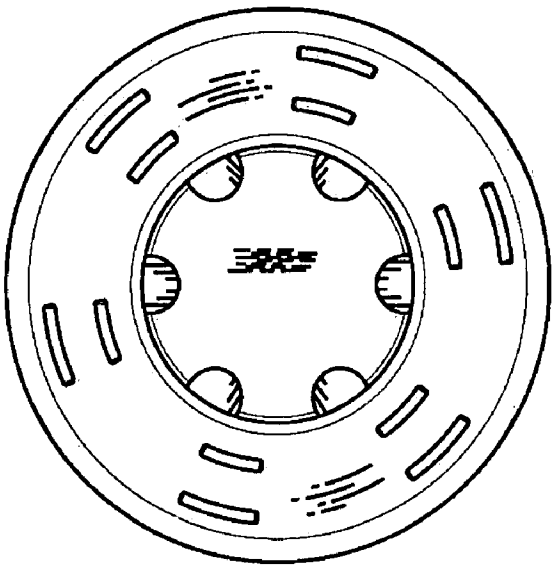
FIG. 28 is a top plan view of a puck with strakes and vents according to the invention, of which the bottom plan view is a symmetric view thereof.

FIGS. 26–28 illustrate the design aspects of a third embodiment of the invention.

The present invention may be embodied in other specific forms without departing from its spirit or significant characteristics. The described embodiments are to be considered in all respects only as illustrative and not restrictive.

Therefore, the scope of the invention is indicated by the appended claims rather than by the foregoing description. All changes that come within the meaning and range of equivalency of the claims are to be embraced within their scope.

What is claimed is:

1. An aerodynamically augmented hockey puck apparatus, comprising:

a striking surface of said hockey puck having a top planar surface with a center pocket cavity, a bottom planar surface with a center pocket cavity, and an outer cylindrical peripheral surface;

a ducted venting system having a plurality of ducts symmetric about said outer cylindrical peripheral surface, each of said ducts having an inlet formed in said outer cylindrical peripheral surface and an outlet formed in either said top planar surface or said bottom planar surface, wherein said top center pocket cavity receives said outlets of the ducts arranged about a bottom edge of said outer cylindrical peripheral surface and said bottom center pocket cavity receives said outlets of the ducts arranged about a top edge of said outer cylindrical peripheral surface.

2. The apparatus according to claim 1, which further comprises a strake assembly within said hockey puck having multiple strakes partially extending past said striking surface, said multiple strakes inhibiting the escape of airflow from said bottom center pocket cavity to enhance a fountain lift force.

3. The apparatus according to claim 2, wherein said multiple strakes are configured in multiple concentric rows to inhibit the escape of airflow and to enhance a fountain lift force when said hockey puck is in a surface mode.

4. The apparatus according to claim 1, wherein said ducted venting system directs free stream airflow produced by movement of said hockey puck.

5. The apparatus according to claim 1, wherein said ducted venting system via directed vented airflow reduces the force of the coefficient of friction between said bottom planar surface and a playing surface.

6. The apparatus according to claim 1, wherein the ducted venting system generates a fountain lift force in a surface mode.

7. A method of aerodynamically augmenting a puck, the method which comprises the following steps:

providing equalization vented ducts extending from an upper edge of an outer cylindrical surface to a lower planar surface of the puck;

providing equalization vented ducts extending from a lower edge of the outer cylindrical surface to an upper planar surface of the puck; and automatically ducting high pressure air on an outer cylindrical surface edge to a lower pressure on an opposite planar surface of the puck.

8. The method according to claim 7, wherein the equalization vented ducts extend symmetrically and radially from a central axis of the puck towards the outer cylindrical surface of the puck.

9. The method according to claim 7, wherein the step of automatically venting high pressure air further comprises venting high pressure air on an outer cylindrical surface edge to a lower pressure central cavity on the opposite planar surface of the puck.

10. The method according to claim 7, wherein the puck is in one of an airborne mode and a surface mode.

* * * * *